US005546638A

United States Patent [19]

Chiodaroli

[11] Patent Number: 5,546,638

[45] Date of Patent: Aug. 20, 1996

[54] SHEET CLAMP

[75] Inventor: Michelangelo Chiodaroli, Milan, Italy

[73] Assignee: I.M.L. Industria Meccanica Lombarda S.R.L., Offanego, Italy

[21] Appl. No.: 325,506

[22] Filed: Oct. 19, 1994

[30] Foreign Application Priority Data

Oct. 19, 1993 [IT] Italy ..... MI93U00796

[51] Int. Cl.[6] ..... B42F 1/10

[52] U.S. Cl. ..... 24/67.9; 24/543; 24/562

[58] Field of Search ..... 24/543, 518, 562, 24/545, 67 R, 67.3, 67.9

[56] References Cited

U.S. PATENT DOCUMENTS

| | | | |
|---|---|---|---|
| 497,972 | 5/1893 | Welch | 24/562 X |
| 3,328,208 | 6/1967 | Hurley, Jr. | 24/543 X |
| 3,755,859 | 9/1973 | Solari | 24/543 X |
| 3,823,443 | 7/1974 | Takabayashi | 24/543 X |
| 4,742,601 | 5/1988 | Furutsu | 24/543 X |
| 4,960,521 | 10/1990 | Keller | 24/543 X |

FOREIGN PATENT DOCUMENTS

| | | | |
|---|---|---|---|
| 83176 | 12/1894 | Germany . | |
| 10425 | 1/1915 | United Kingdom | 24/518 |
| 442277 | 2/1936 | United Kingdom . | |

*Primary Examiner*—James R. Brittain
*Attorney, Agent, or Firm*—Young & Thompson

[57] ABSTRACT

A clamp, particularly suitable for tidily restraining a set of sheets, documents and the like, appropriately grouped together in a form suitable for easy consultation thereof, preventing individual sheets from falling out or becoming lost. The clamp includes two clamping jaws longitudinally extending and provided on one side with opposite clamping edges for gripping the set of sheets to be clamped; the two jaws are hinged at one of their ends and are provided with a snap-engaging device which can be manually disengaged to allow the insertion or removal of the sheets. The clamp is particularly suitable for gripping a set of individual paper sheets, magazines, newspapers or for other similar applications.

4 Claims, 2 Drawing Sheets

SHEET CLAMP

BACKGROUND OF THE INVENTION

1. Field of the Invention

The present invention relates to a sheet clamp intended to be applied along a lateral edge of a set of sheets, documents, a newspaper, magazine or the like to maintain them in a tidy form and suitable for consultation thereof, preventing individual sheets or individual pages from becoming lost or falling out untidily.

2. Description of the Related Art

As is known, in many cases the need arises for displaying or making available to the public a certain number of documents which must be kept and maintained in an ordered form to facilitate or allow reading or consultation thereof.

For example in many places open to the public it is customary to display newspapers, magazines or the like, arranging them on a table or on a shelf, leaving the reader, having finished consultation, to replace the newspaper or magazine tidily on the same table or on the shelf from which it had been taken. In the case of newspapers, or more generally in the case of a set of document sheets where the individual sheets are not attached one to the other, there is the risk of individual sheets falling out, becoming lost or spoiled, thus making consultation thereof difficult.

Presently some remedies are used which do not allow anyone to maintain documents or sheets in an ordered form suitable to facilitate their reading and consultation thereof.

The object of the present invention is to provide a sheet holder clamp for the uses referenced previously, by means of which it is possible to maintain a set of documents, a newspaper or magazine in a constantly ordered condition suitable for reading, preventing individual sheets or individual pages from falling out and becoming lost accidentally.

A further object of the present invention is to provide a sheet holder clamp, as referred to above, by means of which it is possible to maintain the set of documents, the newspaper or magazine resting on any shelf or hanging from a wall.

Yet a further object of the present invention is to provide a sheet holder clamp which is easy to use, economical to manufacture and adapts automatically to restrain, firmly clamped along one of their edges, either a small number of sheets or a set of greater thickness.

SUMMARY OF THE INVENTION

The above is possible by means of a sheet holder clamp designed to restrain a set of sheets, a newspaper, magazine or the like by gripping it along an edge, comprising a substantially elongated body having first and second clamping jaws, hingedly connected at one of their ends to be moved between an open condition and a closed condition to restrain said set of sheets, and in which said jaws of the clamp comprise opposite clamping surfaces parallelly extending on one side of the clamp, said clamping surfaces being spaced apart to define a longitudinal groove for insertion of the above-mentioned set of sheets, at least one of said clamping surfaces having projections which extend towards the other one of said clamping surfaces, and disengageable hooking means being provided to maintain the jaws of the clamp in the closed condition.

BRIEF DESCRIPTION OF THE DRAWINGS

A preferred embodiment of a sheet holder clamp according to the invention will be illustrated hereinunder with reference to the accompanying drawings, in which.

DETAILED DESCRIPTION OF THE PREFERRED EMBODIMENT

As shown in the various figures, the clamp 10, has a substantially elongated body consisting of a first jaw 11 and a second jaw 12 longitudinally extending and hingedly connected to each other, for example by means of a flexible hinge 13, provided at one end of the clamp itself.

Figure 1:
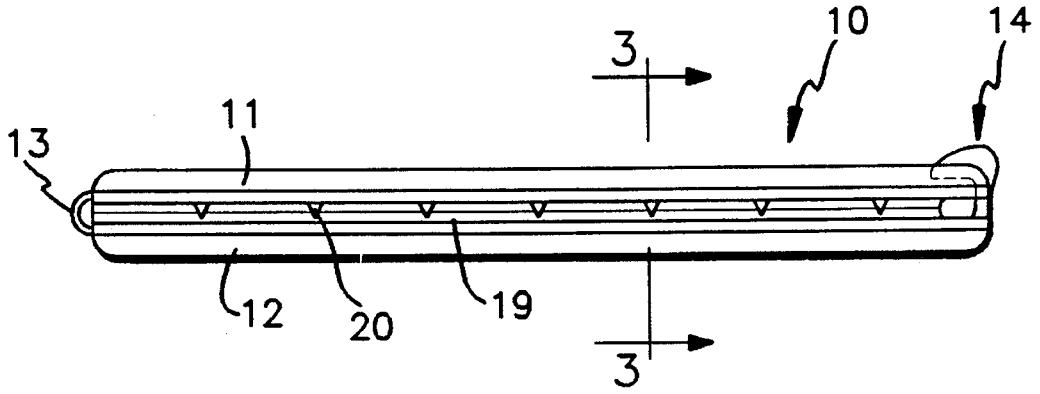
FIG. 1 is a front view of the clamp, in a closed condition.

In FIG. 1 a snap-engaging hooking device, 14 can automatically be engaged by closing the clamp for restraining the two jaws 11 and 12 of the clamp in the closed condition of FIG. 1, or disengaged by hand for opening the clamp.

Figure 2:
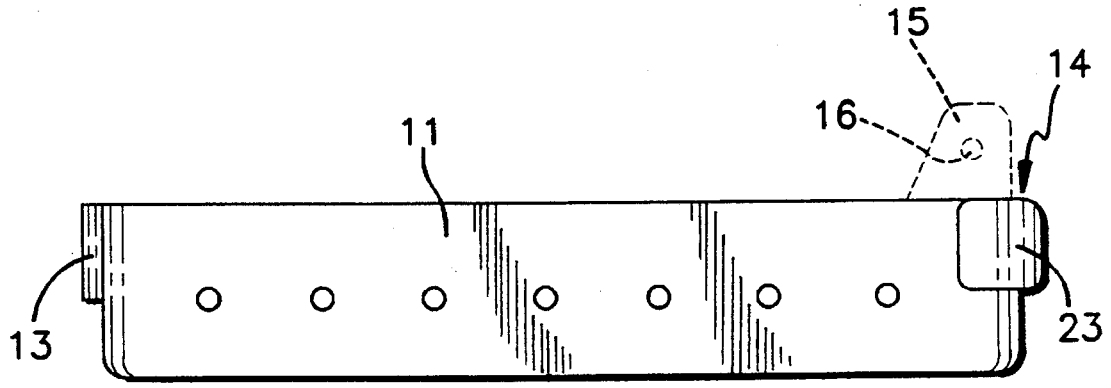
FIG. 2 is a top view of the clamp of FIG. 1.

Finally in FIG. 2 a lateral fin 15 is provided with a hole 16 to allow the clamp, with a set of sheets, a magazine or a newspaper clasped therein, to be hung.

Figure 3:
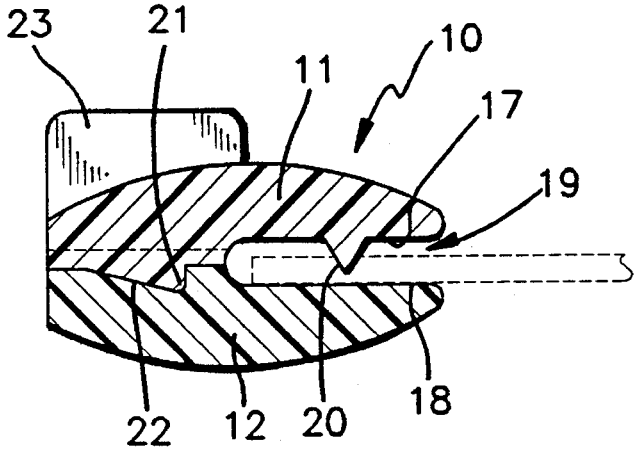
FIG. 3 is an enlarged cross sectional view along line 3—3 of FIG. 1.
Figure 4:
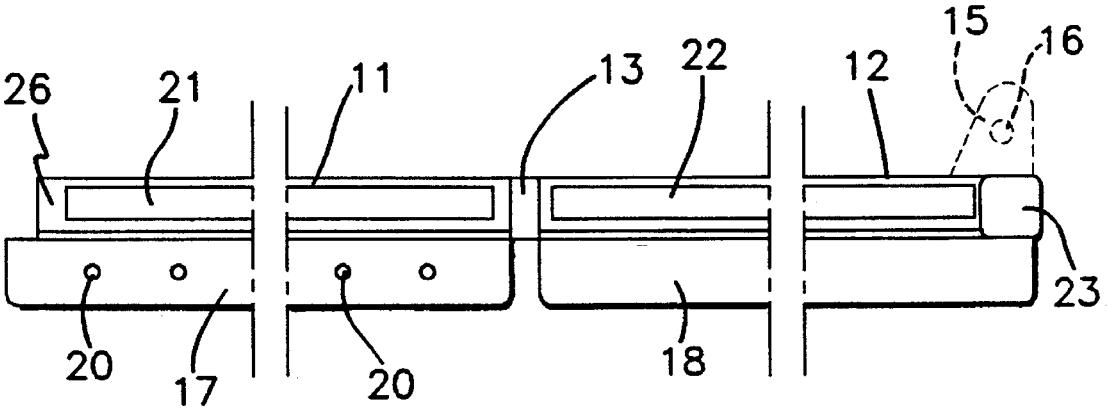
FIG. 4 is a view of the clamp in an open condition.

As illustrated in greater detail in the cross section of FIG. 3 and in the views of FIGS. 1 and 4, the two jaws 11, 12 of the clamp have one longitudinal side provided with flat surfaces 17 and 18 which extend longitudinally from one end to the other of each jaw, said flat surfaces 17 and 18 in the closed condition of the clamp are parallely arranged and appropriately spaced apart to define a longitudinal groove 19 for inserting one edge of the set of documents or of the newspaper to be gripped.

Since the thickness of the set of documents or sheets to be clasped may vary from case to case, it has been envisaged to maintain a sufficient distance between the flat surfaces 17, 18 for containing the greatest thickness of documents, therefore providing on one or both surfaces 17, 18 of the two clamping jaws with a toothing or a set of pointed projections 20 which extend towards the surface 17, 18 of the opposite clamping jaw. In this way it is possible to grip the set of sheets of paper or documents firmly, independently of their thickness.

As shown in the view in FIG. 1 and in the section of FIG. 3, the projections 20 are longitudinally aligned at a predetermined space, in a position intermediate to the flat surface 17 of the upper jaw 11. Nevertheless it is clear that said projections 20 could be differently shaped or positioned, or also provided on the surface 18 of the opposite jaw 12, according to the case and specific needs.

As shown in the cross sectional view of FIG. 3 in order to prevent the two jaws 11 and 12 of the clamp from deforming and to maintain their longitudinally aligned condition, said jaws 11, 12 have, on the internal side longitudinally extending shoulder surfaces suitably shaped to matching one to the other, for example in the form of longitudinal ribbing 21 on jaw 11 and a corresponding groove 22 on jaw 12 which adapt perfectly one to the other. In this way the touching longitudinal surfaces of the ribbing 21 and of the groove 22 prevent the two jaws of the clamp from moving laterally, contributing to providing a firm hold on the set of sheets inserted in the clamp.

As previously referenced, the clamp 10, opposite to the hinge end, is provided with an automatically snap-engaging hooking device, which can be manually disengaged, for restraining the jaws 11 and 12 of the clamp in the closed condition of FIG. 1, and allowing respectively opening of the clamp in the condition shown in FIG. 4.

Figure 5:
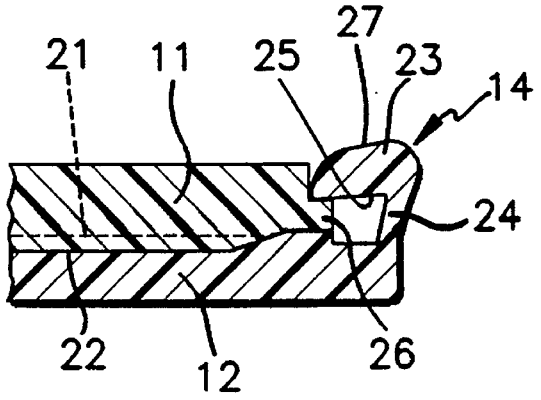
FIG. 5 is an enlarged sectional view of FIG. 2.

More particularly FIG. 5 shows a preferred embodiment of this hooking device 14. As shown, the device 14 comprises a large retaining tooth 23 connected to one end of the jaw 12 of the clamp, by means of an elastically yielding shank 24. The retaining tooth 23 has a lower flat surface 25 which engages with a step shaped projection 26 formed at the corresponding end of the opposite jaw 11. Moreover the tooth 23 has an appropriately rounded upper surface 27 slanting towards the jaw 11 which can be actuated manually to disengage said tooth 23 when the clamp has to be opened, and respectively to cause a backward movement of the tooth 23 and allow automatic hooking on closure of the clamp, by simply pressing one hand down on the upper jaw against the lower jaw. In the example shown, the hooking device 14 is positioned laterally at one end of the clamp, nevertheless the hooking device 14 could be differently formed and positioned, according to requirements. The same projections 20 for clasping the newspaper or sheets could be replaced by transverse teeth or suitable longitudinal scorings which adapt to different thicknesses.

From what has been said and shown in the accompanying drawings, it is therefore clear that a paper holder clamp has been provided for holding a set of documents, a newspaper, magazine and the like, which allows the set of sheets or documents to be maintained always in an ordered form suitable for reading or consultation thereof, preventing individual pages or sheets from accidentally falling out.

The sheet holder clamp according to the invention may advantageously be made in one single part moulded in plastic material or in two parts suitably hinged to each other; nevertheless it is clear that other solutions, configurations, or a combination of materials are possible, without thereby departing from the innovative principles of the present invention.

What is claimed is:

1. A sheet holder clamp (10) to restrain a set of sheets, a newspaper, a magazine, or the like by gripping it along an edge, comprising:

a substantially elongated body having first and second clamping jaws (11, 12) to be moved between an open condition and a closed condition to restrain said set of sheets;

said jaws (11, 12) of the clamp (10) including opposite flat clamping surfaces (17, 18) parallelly and longitudinally extending on one side of the clamp (10), said clamping surfaces (17, 18) being spaced apart to define a longitudinal groove for insertion of the set of sheets, at least one of said clamping surfaces (17, 18) having projections (20) which extend towards the other one of said clamping surfaces (17, 18);

at least one of said clamping surfaces (17, 18) further having longitudinal ribbing (21) on an internal side and the other one of said clamping surfaces (17, 18) having a corresponding groove (22), also on an internal side;

a flexible hinge means (13), provided at one end of the clamp (10), for connecting the jaws (11, 12) together; and disengageable hooking means (14), being provided at an opposite end of the clamp (10), for maintaining the jaws (11, 12) in the closed condition;

said projections (20) being discretely spaced from each other between the ends of the clamp (10).

2. A sheet holder clamp (10) according to claim 1, in which said hooking means (14) includes a retaining tooth means (23), provided on one of said jaws (11, 12), for engaging a projection (26) on the other one of said jaws (11, 12), said retaining tooth means (23), further being connected to said one of the jaws (11,12) by an elastically yielding shank (24).

3. A sheet holder clamp (10) according to claim 2, in which said retaining tooth means (23) includes an upper arched surface (27).

4. A sheet holder clamp (10) according to claim 2, in which one of the jaws (11, 12) is provided with a lateral fin (15) having a hole (16) for hanging the clamp (10).

* * * * *